United States Patent [19]

Indech

[11] 4,211,190

[45] Jul. 8, 1980

[54] GROOVE GUIDED PISTON LINKAGE FOR AN INTERNAL COMBUSTION ENGINE

[76] Inventor: Robert Indech, 37 Mendon St., Worcester, Mass. 01604

[21] Appl. No.: 912,385

[22] Filed: Jun. 5, 1978

Related U.S. Application Data

[63] Continuation-in-part of Ser. No. 881,192, Feb. 27, 1978, abandoned.

[51] Int. Cl.[3] ..... F02E 75/04; F02B 75/32

[52] U.S. Cl. ..... 123/48 B; 123/56 AA; 123/78 F; 123/197 AC

[58] Field of Search ..... 123/54 R, 54 A, 54 B, 123/56 R, 56 A, 56 AA, 56 AB, 48 B, 78 F, 78 R, 78 E, 197 R, 197 AB, 197 AC

[56] References Cited

U.S. PATENT DOCUMENTS

| | | | |
|---|---|---|---|
| 861,711 | 7/1930 | Croft | 123/65 P |
| 1,312,585 | 8/1919 | Shepherd | 123/78 F |
| 1,442,510 | 1/1923 | Aitken | 123/56 AA |
| 1,595,917 | 8/1926 | Owen | 123/197 AC |
| 1,873,908 | 8/1932 | Schinke | 123/197 AC |
| 1,904,680 | 4/1933 | Ferry | 123/55 AA |
| 2,164,612 | 7/1939 | Harrington | 123/197 AB |
| 3,945,358 | 3/1976 | Collins | 123/56 AA |

FOREIGN PATENT DOCUMENTS

| | | | |
|---|---|---|---|
| 303067 | 8/1931 | Fed. Rep. of Germany | 123/78 F |
| 20366 | of 1906 | United Kingdom | 123/56 AA |

*Primary Examiner*—Charles J. Myhre
*Assistant Examiner*—Craig R. Feinberg
*Attorney, Agent, or Firm*—Max Schwartz

[57] ABSTRACT

A conventional internal combustion engine cylinder is provided with an integral downwardly extending housing formed by spaced wall portions tapering outwardly to an annular bottom end. A piston is reciprocable in the cylinder and the cylinder is provided with conventional intake and exhaust valves and a spark plug. An elongated connecting rod extends from the piston to the lower annular portion of the housing. The drive shaft extends into the center of the annular housing portion through one wall thereof. A crank arm extends at right angles from the end of the drive shaft. The crank arm is slotted from adjacent its outer end to adjacent the drive shaft. The end of the connecting rod is provided with a pin at right angles which extends through the slot in the crank arm. A guide channel or groove is cut in the housing wall through which the drive shaft extends. This groove is constructed from two circles, one centered on the axis of the drive shaft with a radius to the outer end of the slot in the crank arm, and the other centered on the upper end of the connecting rod with a radius equal to the length of the rod. The second circle forms an arc which truncates the first circle. The pin at the end of the connecting rod rides in this groove. Thus at the point of highest compression and at the time of the explosion, the connecting rod will be well past the vertical position, the slotted crank arm permitting movement from one side to the other without moving the piston downwardly to lose any of the power stroke. A further version provides a second groove portion, longer than the original groove, to allow the piston to travel an additional downward movement on the power stroke to utilize all of the explosive force and thus add to the efficiency.

6 Claims, 6 Drawing Figures

GROOVE GUIDED PISTON LINKAGE FOR AN INTERNAL COMBUSTION ENGINE

BACKGROUND OF THE INVENTION

The present application constitutes a continuation in part of my application entitled Internal Combustion Engine, Ser. No. 881,192, filed Feb. 27, 1978 now abandoned.

In conventional engines the torque generated about the power shaft is derived from the explosion pushing against the head of the piston which transfers the force through a connecting rod to a crank arm on a power shaft. At the time of maximum compression and ignition, the connecting rod and crank arm are fully extended in vertical alignment producing no net moment arm about the power shaft. The explosive energy is dissipated unless the ignition is delayed which also reduces the compression. Many constructions have been devised to avoid this by using a cam action on the connecting rod and crank arm. U.S. Pat. Nos. 763742, 1452202, 1505856, 1510677, 1572918, 1595917, 1667213 and 2477376 are examples of attempts to solve this problem. Cam operated drives all fail to produce the desired maximum force on the explosion and lose a great deal of this on the compression stroke. In addition, such constructions are all more complex and costly than the conventional drive and require a multiplicity of parts. Furthermore, no provision is made for lengthening the power stroke to take advantage of all of the expansion and explosive force.

SUMMARY OF THE INVENTION

The present invention redesigns thelinkage between the piston and the power shaft to allow for maximum compression at the time of ignition while simultaneously presenting a net moment arm about the power shaft to derive a usable torque. This is accomplished by providing the cylinder with an integral downwardly extending housing formed by spaced wall portions which taper out to an annular bottom end. A connecting rod from the piston extends into the annular portion of the housing. The drive shaft extends into the center of the annular housing part through one wall thereof. A crank arm extends from the end of the shaft at right angles. The crank arm is slotted along its length. The end of the connecting rod is provided with a pin at right angles which extends through the slotted crank arm. A guide channel or groove is cut in the housing wall and constructed from two circles. One circle is centered on the axis of the drive shaft with a radius to the outer end of the slot in the crank arm and the second circle is centered on the upper end of the connecting rod with a radius equal to the length of the rod. The second circle forms an arc which truncates the first circle. The pin at the end of the connecting rod rides in this groove. Thus, at the point of highest compression and the explosion, the connecting rod will be well past the vertical position, the slotted crank arm permitting movement from one side to the other without moving the piston downwardly to lose any of the power stroke. In an alternative form, an additional groove portion is formed to lengthen the power stroke to take full advantage of all of the explosive force and the expansion before it is dissipated out the exhaust.

DESCRIPTION OF THE INVENTION

For the purpose of illustrating the principle of the present invention, the drawings illustrate a single cylinder and a two cylinder engine conventionally used on lawn mowers, pumps, snow blowers, etc. However, the principle is readily applicable to larger engines with 6 and 8 cylinders such as used in motor vehicles.

Figure 1:
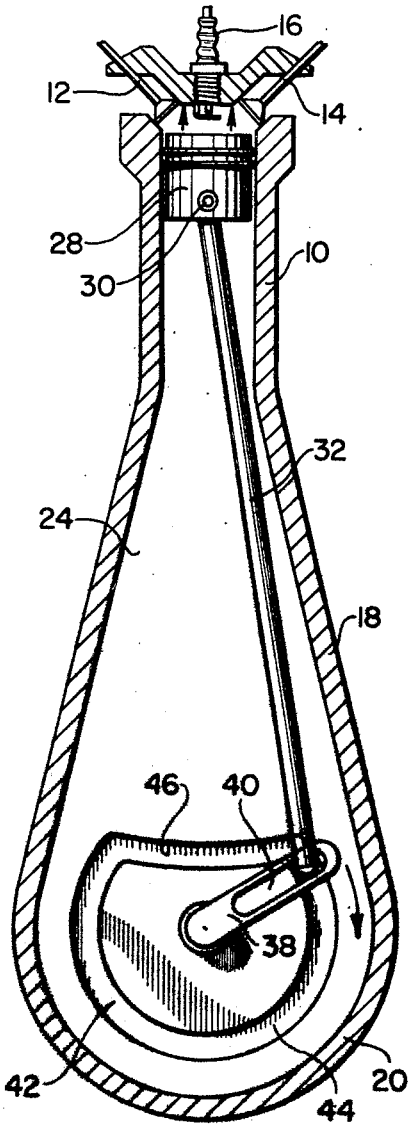
FIG. 1 is a longitudinal section through the cylinder and housing with the piston at maximum compression position.
Figure 2:
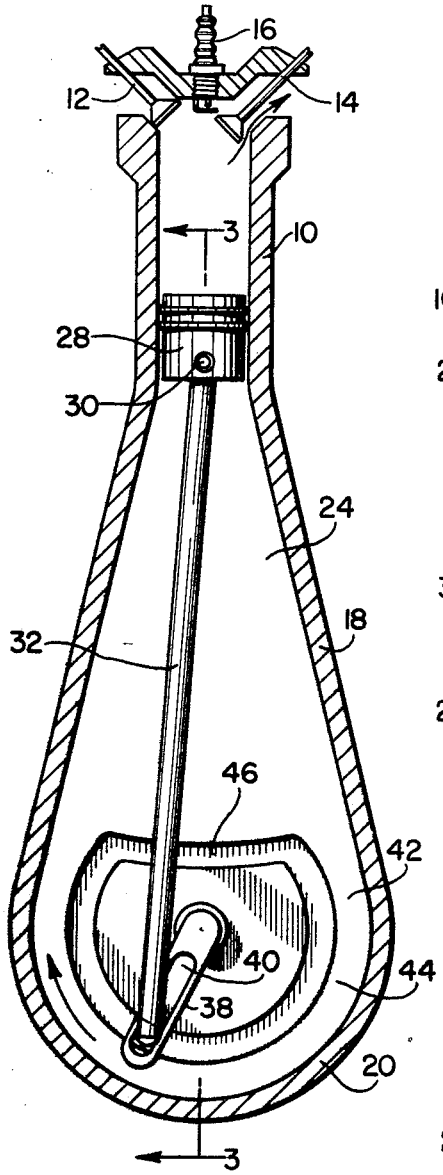
FIG. 2 is a similar view with the piston at the end of the power stroke and turning up to exhaust.
Figure 3:
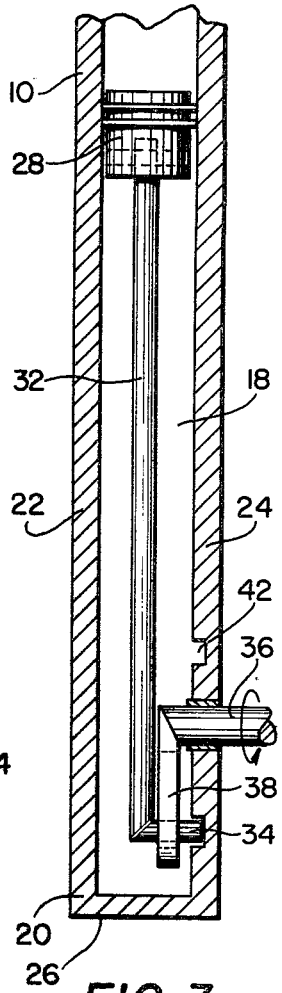
FIG. 3 is a section taken on line 3—3 on FIG. 2.

Referring to FIGS. 1 to 3, inclusive, the cylinder 10 is provided with conventional intake and exhaust valves 12 and 14 and spark plug 16. The cylinder 10 extends downwardly to form a housing 18 widening toward the bottom end to an annular portion 20. The housing is formed with spaced parallel wall portions 22 and 24 and an outer wall 26.

The piston 28 reciprocates vertically in the cylinder 10 and is provided at its bottom with a pivotal connection 30 to the upper end of the connecting rod 32. The bottom end of the rod 32 is provided with an integral pin 34 extending at right angles toward the housing wall 24, see FIG. 3. The drive shaft 36 extends through the housing wall 24 at the center of the annular bottom end 20, FIGS. 1 and 2. The end of the drive shaft 36 is provided with a crank arm 38 extending at right angles to the axis of the shaft. The crank arm 38 is provided with a slot 40 along its length. As can be seen in FIGS. 1, 2 and 3, the pin 34 extends through the slot 40.

Now, the housing wall 24 is provided with a guide groove 42 cut into the face of the wall. The groove 42 is constructed from two circles. One circle is centered on the axis of the shaft 36 with a radius to the outer end of the slot 40 to form the lower portion 44 of the groove, and the other circle is centered on the pivot point 30 for the upper end of the rod 32 with a radius equal to the length of the rod to form the upper portion 46 of the groove. The portion 46 forms an arc which truncates the lower portion circle. The pin 34 rides in the groove 42 thus formed.

With the above construction, the method of operation is obvious. Let us assume that we have a 4-cycle gasoline engine, FIG. 1 then denotes the position of the connecting rod and piston at the peak of compression just prior to ignition. The ignition of the mixture pushes the rod 32 down and rotates the crank arm 38 and power or drive shaft 36 until the 6 o'clock position is reached. Rotational inertia of the drive shaft carries the piston through a conventional exhaust cycle where exhaust gases are released and a fresh gas and air charge is inputted. This process is a full 360 degrees turn of the drive shaft. This leaves the bottom end of the rod 32 at the 6 o'clock position at the bottom end of the portion 44 of the groove 42. The rotational inertia now carries the rod 32 to the groove lportion 46. At this point, the piston is at maximum compression and a slight further inertial movement of the drive shaft swings the bottom end of the rod 32 to the right end of the groove portion 46 without altering the maximum compression position of the piston 28.

As the rod 32 is swung from left to right, it approaches the shaft 36. However, the slot 40 in the crank arm 38 allows for this movement. Unlike other constructions, the movement toward and away from the drive shaft by the connecting rod 32 is accomplished without movement by the piston and without changing the compression or exhaust stroke of the piston.

The above construction thus provides for a redesigned linkage system between the piston and the drive shaft to allow for maximum compression at the time of ignition while at the same time presenting a net moment arm about the drive shaft to derive usable torque at the moment of ignition.

Figure 4:
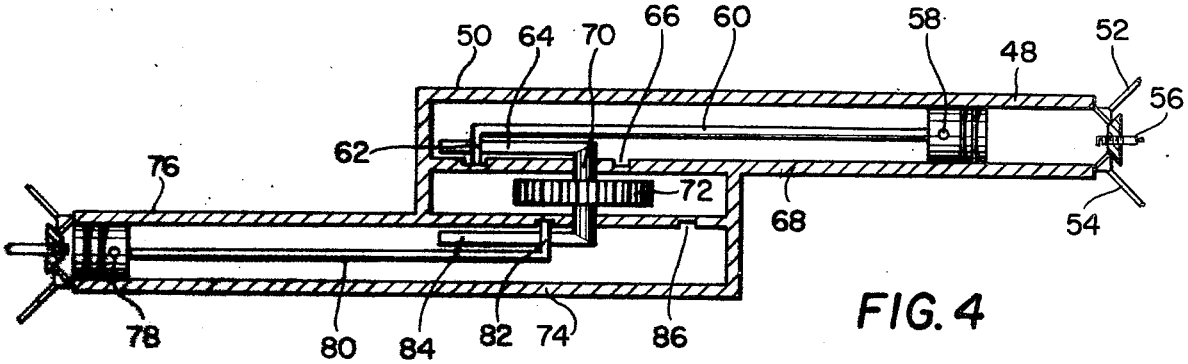
FIG. 4 is a view similar to FIG. 3 showing a two cylinder engine construction.

As stated hereinabove, FIGS. 1 to 3 illustrate the principle applied to a single cylinder. FIG. 4 illustrates the same principle applied to a two cylinder construction. In this form, the two cylinders are shown in opposed relation so that one is firing as the other is exhausting.

Referring more in detail to FIG. 4, the cylinder 48 and housing 50 are as in the form shown in FIG. 1. The cylinder 48 is provided with the intake and exhaust valves 52 and 54 and spark plug 56. The piston 58 is connected to the connecting rod 60 which is provided with the pin 62. The pin 62 passes through the crank arm 64 into the groove 66 in the housing wall 68. The crank arm 64 rotates the shaft 70 on which a gear 72 is mounted to drive the drive shaft (not shown).

Integral with the housing 50 is a second housing 74 and cylinder 76 also having the valves, spark plug, and piston 78 with a connecting rod 80. The rod 80 has a pin 82 extending through the crank arm 84 into a groove 86 and rotating the same shaft 70 and gear 72. In this form, the cylinders 48 and 78 are in apposed position. However, they can be side by side or in any other angular position. Also, since the main drive is through the gear 72, similar pairs of cylinders can be positioned to drive the same drive shaft with different gears. Thus, 4, 6 or 8 cylinder engines can be constructed.

Whether the single cylinder shown in FIG. 1 is used or the multiple cylinder shown in FIG. 4, the basic principle is the same and the results are the same in the savings of fuel and power. Excluding frictional losses, the relative output torque gain could be as much as 40%.

Internal combustion engines, including those herein described, lose a considerable amount of power out of the exhaust. This is the result of a residual amount of expansion power left in the power stroke when the crank arm and connecting rod reach the lowermost position and start the exhaust stroke. To utilize this residual power and thus increase the efficiency of the engine, the construction shown in FIGS. 5 and 6 may be used.

As in the form shown in FIG. 1, the engine comprises a cylinder 88 provided with the intake and exhaust valves 90 and 92 and spark plug 94. The cylinder widens at 96 to form a housing with an annular bottom portion 98. The piston 100 reciprocates in the cylinder 88 and is pivotally connected to the rod 102. The bottom end of the connecting rod 102 is provided with an integral pin extending at right angles toward the housing wall 104, as in the previous forms. The drive shaft extends through the housing wall 104 and is provided with a crank arm 106 at right angles to the axis of the shaft. The arm 106 is provided with a slot 108, the connecting rod pin extending through the slot.

In this form, the housing wall 104 is provided with a more complex groove arrangement than that shown in FIG. 1. The main groove 110 is similar to the groove 44 and has a shallow curved upper end 112. An additional groove 114 extends across the arms of the groove 110 in parallel relation to the upper groove portion 112.

Figure 5:
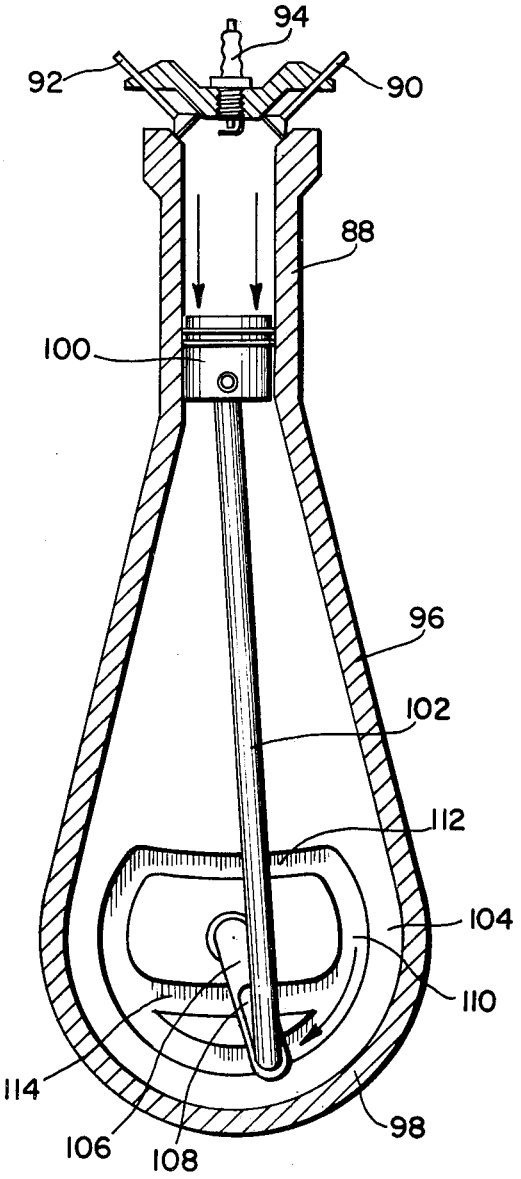
FIG. 5 is a view similar to FIG. 1 showing a modified form of the invention with the piston approaching the end of the power stroke.
Figure 6:
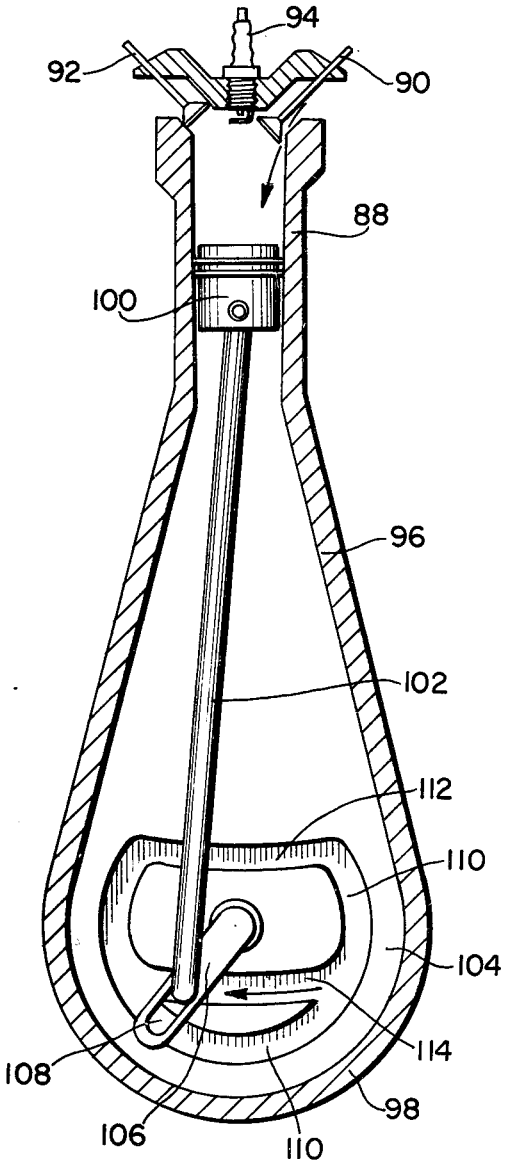
FIG. 6 is a view similar to FIG. 5 with the piston at the end of the intake stroke just prior to compression.

The operation of this form is as follows: the lower end of the connecting rod moves from the upper right (1 o'clock) position in FIG. 6 to and into the groove 114 (arrow) to form the intake stroke. From the position shown in FIG. 6 back to the groove 110 and up to the groove 112 is the compression stroke. Now, down along the groove 110 to the bottom, FIG. 5, is the expansion or power stroke. Then upwardly back to groove 112 is the exhaust stroke.

Thus the power stroke is extended so that it is longer than the compression stroke. This enables the piston to make complete use of all of the expansion power of the mixture. None of the power is lost through the exhaust. This form results in a considerable increase in the efficiency of the engine. Note that on intake the crank arm is pulling the connecting rod to produce a vector inwardly and cause the pin to ride into the groove 114. The power stroke is a downward thrust and the force causes the connecting rod to stay in the groove 110 all the way to the bottom end. Thus the movement is automatic and requires no additional construction.

The various forms of the present invention produce a considerable saving in fuel and efficiency. Other advantages of the present invention will be readily apparent to a person skilled in the art.

I claim:

1. In an internal combustion engine having a cylinder, a piston reciprocable in said cylinder, and a connecting rod pivotally connected at one end to said piston, a housing wall extending integrally from said cylinder, said wall tapering outwardly and terminating in an annular bottom end, a drive shaft extending through said annular wall portion with its axis at right angles to the stroke of said piston in alignment therewith and linkage means between said connecting rod and said drive shaft for rotating said drive shaft, said linkage means positioning said connecting rod out of alignment with the axis of the piston stroke at the period of highest compression and ignition, said piston being motionless at the period of highest compression, said connecting rod moving out of alignment with the axis of the piston stroke during the motionless period of said piston, the power stroke and exhaust stroke of said linkage being identical and centered about the axis of said drive shaft; wherein said linkage includes a slotted crank arm at the end of said drive shaft, said connecting rod being linked to said crank arm, and means for guiding the lower end of said connecting rod around the end of said drive shaft, and said connecting rod is provided with a pin at right angles to it lower end said pin extending through said crank arm slot; and wherein said guide means comprises a groove cut into said housing wall, said groove comprising a lower first circle portion and a truncated upper portion formed by the arc of a second circle curving in the direction of the center of the first circle portion wherein curvature of the second circle portion is less than that of the first circle portion.

2. In an internal combustion engine as in claim 1, wherein the power and exhaust strokes are longer than the intake and compression strokes of said piston.

3. In an internal combustion engine as in claim 1, wherein said second arc is centered at the upper end of said connecting rod and having a radius equal to the length of said connecting rod.

4. In an internal combustion engine as in claim 1, wherein an auxiliary tansverse groove extends between said lower and upper groove portions in spaced parallel relation to said upper groove portion, whereby the power and exhaust strokes are longer than the intake and compression strokes of said piston.

5. In an internal combustion engine as in claim 1, wherein said lower groove portion is formed with a radius equal to said crank arm slot and centered on said drive shaft.

6. In an interal combustion engine as in claim 5, wherein said second arc is centered at the upper end of said connecting rod and having a radius equal to the length of said connecting end.

* * * * *